United States Patent [19]

Oudenhoven

[11] 4,394,051

[45] Jul. 19, 1983

[54] METHOD OF HYDROSPALLING

[75] Inventor: Martin S. Oudenhoven, Lakewood, Colo.

[73] Assignee: The United States of America as represented by the Secretary of the Interior, Washington, D.C.

[21] Appl. No.: 270,038

[22] Filed: Jun. 3, 1981

[51] Int. Cl.[3] ..... E21C 37/06

[52] U.S. Cl. ..... 299/16; 166/308

[58] Field of Search ..... 299/15, 17, 21, 16

[56] References Cited

U.S. PATENT DOCUMENTS

| | | | |
|---|---|---|---|
| 3,507,540 | 4/1970 | Silverman | 299/21 X |
| 3,988,037 | 10/1976 | Denisart et al. | 299/16 |
| 4,193,634 | 3/1980 | Nakamura et al. | 299/17 |

FOREIGN PATENT DOCUMENTS

| | | | |
|---|---|---|---|
| 38761 | 5/1956 | Poland | 299/16 |

*Primary Examiner*—Ernest R. Purser

*Attorney, Agent, or Firm*—Thomas Zack; Donald A. Gardiner

[57] ABSTRACT

A method of breaking rock from a free surface which uses hydrofracturing to induce rock failure. Initially, a hole is cut in the rock face to a depth suitable for spalling by a high pressure water jet drill. Next, at the bottom of this hole a thin circular slot is hydraulically cut into the rock. The slot's circular axis is cut parallel to the transverse axis of the hole and the slot is made larger than the hole diameter. Following this step, a high pressure packer, with a high pressure tube passing through its center, is inserted into the drill hole. This packer is placed near the bottom of the hole above the slot and inflated. A fluid, like water, under high pressure is pumped down the hole past the packer into the slotted area. This high pressure fluid initiates a tensile fracture in the rock at the circular periphery of the slot. Tension is induced in the rock at this peripheral location due to the small radius of curvature existing there. This circular tensile fracture propagates outward away from the drill hole and upward to the free rock surface. After the rock fragment is broken free, pressure is released from the packer and it is withdrawn from the hole letting the fragment drop. To advance through the rock, the process is continuously repeated with the high pressure fluid being applied to the slotted area over a very short time period.

5 Claims, 7 Drawing Figures

Fig 1.
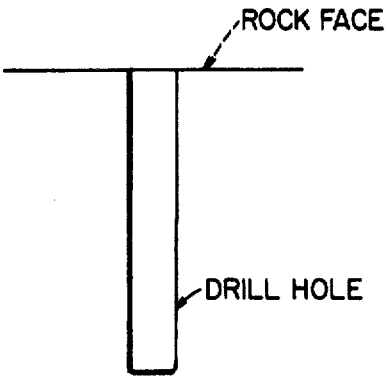
Fig 3.
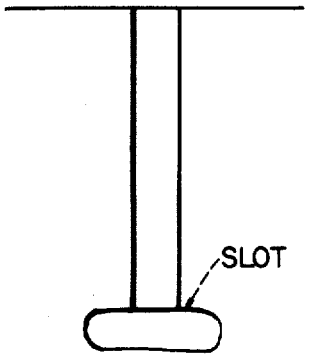
Fig 4.
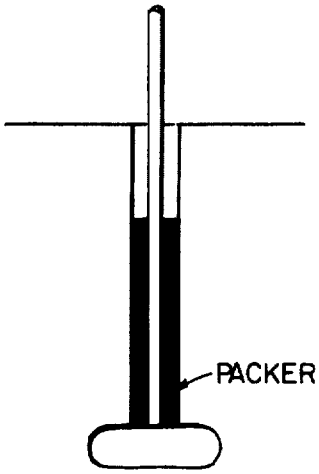
Fig 2.
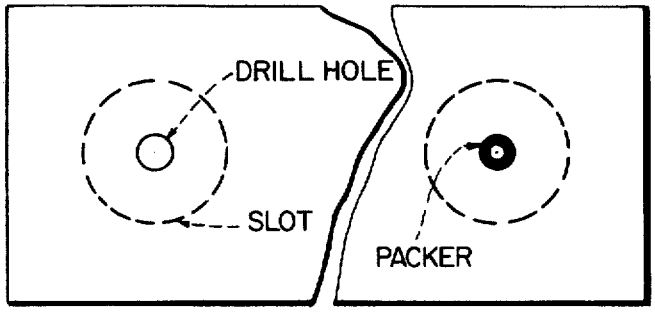
Fig 5.

METHOD OF HYDROSPALLING

BACKGROUND OF THE INVENTION

1. Field of the Invention

This invention is a method of fracturing rocks using high pressure fluid.

2. Description of the Prior Art

The prior art discloses many methods to fracture rocks using hydraulic fluids. In the U.S. Pat. No. 3,507,540 (D. Silverman), there is disclosed a method of cutting large diameter bore holes in rocks. To accomplish its objective: a circular channel is first cut, and rock is broken off this channel by a transverse fracture by inserting an inflated packer near the bottom of the channel and then pass fracturing liquid through the packer. In an alternate embodiment, small diameter holes are drilled in the column of rock to the depth of the channel. Then a packer is placed in a central hole and inflated with fracturing liquid being injected beneath the packer into the volume at the base of the hole. Whichever of the two Silverman methods are employed, a fracture propagates from one drilled hole to another to detach a relatively large core. Neither of these are used with my method wherein a three-dimensional fracture propagates from a slot in the bottom of a single small drilled hole to the free surface. Thus, I employ a simpler procedure with less cutting in a near surface fracturing method.

The United States Patent to C. E. Reistle, Jr., (2,547,778) shows a borehole with a fracture directed in a radial outward direction (see FIG. 2 therein). And the U.S. Pat. No. 3,018,095 (J. F. Radlinger) discloses a method using hydraulic fracturing between underground wells. Both of these two inventions differ from my invention in that they are not for removing rocks from a free surface. In still another patent (U.S. Pat. No. 3,988,037 to J. P. Denisart et al.), a hole has hydraulic fluid compacted into it with a piston therein to cause tensile stress cracks. Shock waves generated by the piston do the fracturing. My invention does not depend on piston strokes to fracture rocks but does depend on the materials' properties of low tensile strength and the geometry of the slot. A lower fluid pressure using less energy to induce a rock fracture is possible because of the slot geometry and the fracture it initiates parallel to the free surface. My invention has as its object the breaking of a hard material whose tensile strength is much less than its compressive strength which would include rocks such as granite, limestone, sandstone, marble, etc. It does not depend on creating an impact velocity sufficient to cause cracks in the material, i.e. dynamic loading, such as with a water hammer. The two U.S. Pat. Nos. (4,123,108 and 4,141,592) to Erik V. Lavon disclose such dynamic loading systems.

SUMMARY OF THE INVENTION

The method disclosed and claimed herein is for breaking rock from a free surface by using hydrofracturing to induce rock failure. Four essential steps are used to practice this invention. Initially, a hole is cut from the free surface into the rock face to a depth suitable for spalling. Next, a relatively thin circular slot with a larger diameter than the hole is cut at the bottom of the hole and oriented so that the plane of the slot is parallel to the rock surface. Third, a high pressure packer and high pressure tube are inserted into the hole at the bottom to seal the hole. And last, a liquid under high pressure is injected through the high pressure tube and packer into the slotted volume to induce pressure on the upper and lower surfaces of the circular slot thus initiating a tensile fracture at or near the peripheral area of the slot. This last step causes a circular tensile fracture which propagates, in a curved path, outwardly away from the hole towards the free surface to yield an inverted cone-shaped rock fragment.

The primary object of this invention is a new method of inducing a fracture in rock material for the purpose of breaking rock.

DESCRIPTION OF THE DRAWINGS

FIG. 1 illustrates the first step used to practice this invention.

FIGS. 2 and 3 show, in a top and side view, respectively, how the slot is formed at the bottom of the hole.

FIGS. 4 and 5 depict the step of placing the packer in the hole.

FIG. 1 illustrates the first step used to practice my invention which is to cut or drill a hole from the free surface into the material (rock) to be ultimately removed. Normally a small diameter hole is drilled to a predetermined depth. The actual depth drilled to is based on several factors such as the rock fracture patterns, smoothness of the final rock wall desired, and the coarseness of the particular rock which is being handled. Preferably, however, a high pressure water jet is used to drill the hole such as that disclosed on pages 116 to 120, exclusive, of the February 1977 Coal Age magazine article entitled "Water-Jet Drilling for Roof Bolts May Save Time and Costs in Mines" by Nicholas P. Chironis. The contents of this article are specifically incorporated by reference herein. This type of drill would allow a small diameter (⅜ to 1 inch) hole to be drilled with about 35,000 psi. as the water bores into the rock at 1,200 rpm. For Colorado sunset sandstone material having a 21,000 psi compressive strength, this type of drill could bore 10 feet per minute (fpm) which is about twice as fast as a typical mechanical drill would do for the same diameter hole. Also, the energy need to drill with the water jet would be one-quarter that of the mechanical drill for the same hole.

The next step after drilling the hole to its predetermined depth is to drill a thin, circular slot extending from the bottom of the hole. As best shown in FIGS. 2 and 3, the slot is oriented so that its circular axis is generally parallel to the transverse axis of the drilled hole with the thinner dimension of the slot being generally vertical. Thus, from above (see FIG. 2), the slot would appear circular, larger, and approximately concentric with the previous drilled hole. The actual diameter of the slot is directly related to the volume of rock to be spalled from the free rock face surface. Hence, the larger the diameter of the slot, the more rock will be removed. A water jet drill having either a nozzle with a fixed orientation at 90 degrees to the hole's longitudinal axis (or depth) or a nozzle that can swivel to that orientation can be used to drill the slot.

The next step is to install a flexible inflatable high pressure packer with a high pressure tube passing through its center in the drill hole near its bottom. FIGS. 4 and 5 show how such a packer would be placed just above the slot. After located in its desired position, the packer is inflated to form a blocking ring around its center tube.

Figure 6:
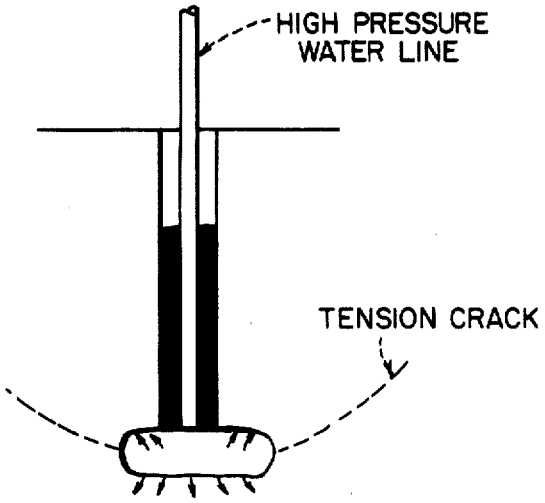
FIG. 6 discloses the step of injecting a high pressure fluid into the hole/slot to initiate the tensile fracture.
Figure 7:
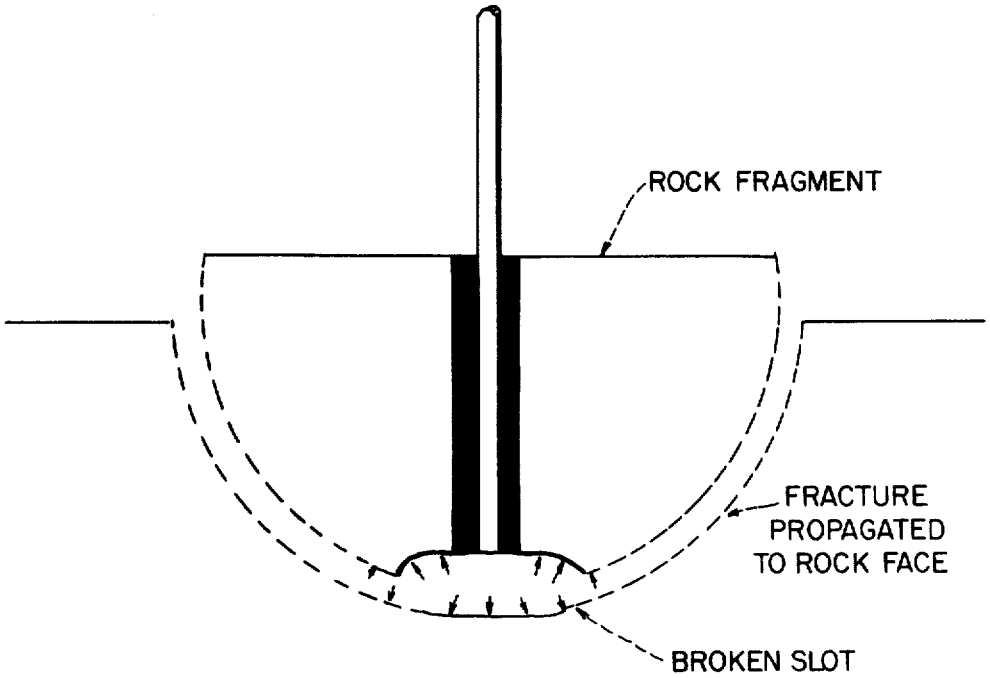
FIG. 7 shows the inverted cone rock fragment as detached from the rock face.

Following this water or another incompressible fluid is pumped under high pressure (100 to 10,000 psi) through the center tube past the packer into the slot volume. This high pressure fluid, upon filling and pressurizing the slot cavity, initiates within a fraction of a second, a tensile fracture in the surrounding rock which emanates from the circular periphery of the slot to the upper free surface. Fluid pressure sufficient to propagate the crack is maintained until the rock fragment breaks loose from the rock surface as shown in FIG. 7. After the rock fragment has broken free, the air pressure applied to the packer is decreased and the packer is withdrawn from the hole causing the fragment to drop. If a depth greater than that broken away is desired, the process can be continuously repeated to advance through and into the rock.

To make the rock fracturing process mechanically sound and more efficient, the water under high pressure being applied to the slot volume should be applied over a very short (approximately 100th of a second) period. Using a short time interval in applying the pressure increases the friction between the rock and water which allows the high pressure to be maintained during crack propagation. In this way less water will have to be bled off when breaking consolidated or unconsolidated rock. Some testing to determine the correct pressure and period over which the pressure is sustained will be required for different rock, rock fracture frequency, and amount of rock removed. This preliminary testing to determine the workable parameter magnitudes will result in continuous successful operation of the hydrospalling procedure.

The advantages of using the method disclosed herein are many fold. There would be a more rapid advance—about 100 feet in a 24-hour work period-than present state of the art rock drilling methods. There would be less danger to miners from broken rock fragment flying about since less energy is used. There would be no release of toxic fumes, such as the gases from explosives, thereby requiring no increase in ventilation equipment or down time for gases to clear. Adjacent rocks would be damaged less and dust in the air would be reduced because of the water jets used. The fragment rock size can be better controlled and a smoother finish is obtained on the final rock wall and less energy would probably be used than present drilling methods.

One point should be clear and that is my invention finds its principle utility in breaking hard material, like rock, whose tensile strength is much less than its compressive strength as in granite, sandstone, and marble where their ratios of compressive to tensile strengths are 5.4:1, 14.2:1, and 17.1:1, respectively. The tensile failure of the material occurs when the geometry of the slot cross-section is changed by the internally applied hydraulic pressure, thus creating a tensile stress in the material at the slot periphery. The Article, "Theory of Notch Stresses: Principles for Exact Stress Calculation," by H. Neuber, Berlin, 1937, on pages 39–42 discusses this point.

Critical to the operation of this invention is the low tensile strength of the material being broken and the geometry of the slot cross-section where a small radius of curvature is created at the slot periphery. The radius of curvature at the slot periphery is directly related to the magnitude of pressure required to initiate rock failure. A smaller radius would require less pressure.

Many modifications can be made to the equipment and parameters disclosed in my foregoing process. For example, the slot diameter can be increased and the plane of the slot can be oriented at different angles to the drill hole, the circular hole could be drilled with a conventional percussion drill and the slot with a high pressure water jet cutter. However, such changes are unimportant as this invention should be limited only by the claims which follow.

I claim:

1. A method of hydrofracturing in situ rock material from its free surface when the material's tensile strength is much less than its compressive strength comprising the steps of:

(a) forming a small diameter hole no more than 1 inch in diameter to a predetermined depth in the material to be fractured;

(b) cutting a generally circular slot in the material from near the bottom of the hole formed in step a, said slot extending outwardly from the hole and encircling it;

(c) mounting and inflating an elongated packer assembly having a fluid conduit therethrough in the hole, said packer terminating at its end remote from the hole's entrance near the intersection of the hole with the slot formed in step b; and (d) injecting a fluid under high pressure into said slot's volume through the conduit in the packer assembly to fracture the material with the fracture beginning at or near the periphery of the slot and extending to the material's free surface.

2. The method of claim 1 wherein step (b) is done with a high pressure water jet and the resulting cut slot is larger at its greatest extent than the transverse dimension of the hole and oriented generally parallel to the free surface.

3. The method of claim 1 wherein steps (a) and (b) are accomplished by using high pressure fluid jets to form a cut, respectively, into the in situ material.

4. The method of claim 1 wherein steps (a) to (d) are repeated in that sequence to remove additional material to a greater depth.

5. The method of claim 1 wherein the ratio of compressive strength of the material to its tensile strength is at least 5 to 1 and step d is accomplished by injecting the fluid through a tubular member placed in the packer assembly.

* * * * *